US006484530B1

(12) United States Patent
Hibino et al.

(10) Patent No.: US 6,484,530 B1
(45) Date of Patent: Nov. 26, 2002

(54) FLOW-DOWN TYPE ICE MAKING MACHINERY

(75) Inventors: Takashi Hibino, Aichi (JP); Hideji Ota, Aichi (JP)

(73) Assignee: Hoshizaki Denki Kabushiki Kaisha, Toyoake (JP)

( * ) Notice: Subject to any disclaimer, the term of this patent is extended or adjusted under 35 U.S.C. 154(b) by 0 days.

(21) Appl. No.: 09/979,036

(22) PCT Filed: May 16, 2000

(86) PCT No.: PCT/JP00/03133

§ 371 (c)(1),
(2), (4) Date: Nov. 15, 2001

(87) PCT Pub. No.: WO00/70278

PCT Pub. Date: Nov. 23, 2000

(30) Foreign Application Priority Data

May 18, 1999 (JP) ..... 11-137240

(51) Int. Cl.[7] ..... F25C 1/12
(52) U.S. Cl. ..... 62/347; 62/348
(58) Field of Search ..... 62/347, 348, 298

(56) References Cited

U.S. PATENT DOCUMENTS 2,692,155 A * 10/1954 Ayres et al. ..... 277/556
2,959,026 A * 11/1960 Swanson ..... 62/138
5,014,523 A * 5/1991 Kohl ..... 62/347
5,345,782 A * 9/1994 Takahashi et al. ..... 62/344
6,059,732 A * 5/2000 Orr et al. ..... 600/531
6,109,055 A * 8/2000 Kato et al. ..... 62/347

FOREIGN PATENT DOCUMENTS

| | | |
|---|---|---|
| JP | 5-240540 | 9/1993 |
| JP | 5-240541 | 9/1993 |
| JP | 7-77373 | 3/1995 |
| JP | 7-260305 | 10/1995 |
| JP | 8-313133 | 11/1996 |

* cited by examiner

*Primary Examiner*—William E. Tapolcai
(74) *Attorney, Agent, or Firm*—Wenderoth, Lind & Ponack, L.L.P.

(57) ABSTRACT

A water storage tank assembly 12 is accommodated so that it can be pulled out and extended over an ice making chamber 1 and a machine chamber 2 by passing through a lower portion of a partition wall part 4 by which the ice making chamber 1 is separated from the machine chamber 2. In the water storage tank assembly, a cube guide 16 is attached to a water storage tank 13 on the side of the ice making chamber. On the other hand, a pump motor 14 and a float switch 15 are attached to the water storage tank on the side of the machine chamber. The water storage tank assembly can be pulled out so that the water storage tank, the cube guide, the pump motor and the float switch, etc. can be completely cleaned to all corners.

15 Claims, 11 Drawing Sheets

FLOW-DOWN TYPE ICE MAKING MACHINERY

BACKGROUND OF THE INVENTION

1. Field of the Invention

The present invention relates to a water trickle type ice making machine, and more particularly to an attaching structure for a water storage tank.

2. Description of Related Art

Conventional water trickle type ice making machines are disclosed in U.S. Pat. Nos. 5,291,752, 5,582,018, and 5,722,244. In the water trickle type ice making machines disclosed in these publications, a water storage tank is located below what is called an evaporator assembly provided with an ice making plate or an evaporator and is formed integrally with an ice making machine body. Further, in the conventional water trickle type ice making machines disclosed in Japanese Utility Model Examined Publication No. 60-46349, Japanese Utility Model Examined Publication No. 60-32851 and Japanese Utility Model Examined Publication No. 60-35016, a water storage tank and a circulating pump are detachably attached to the ice making machine by fixing means such as screws.

In the water trickle type ice making machines, since deposits, scale or the like are accumulated in the water storage tank itself or the peripheral part thereof under an operation for a long period, it is necessary to periodically clean and remove these deposits, scale or the like. However, in the above described water trickle type ice making machines disclosed in the U.S. Pat. Nos. 5,291,752, 5,582,018 and 5,722,244, since the water storage tank cannot be detached from the ice making machine body, it is inconvenient and difficult to clean the minute parts of the water storage tank. Further, in the conventional water trickle type ice making machines disclosed in the Japanese Utility Model Examined Publication No. 60-46349, the Japanese Utility Model Examined Publication No. 60-32851 and the Japanese Utility Model Examined Publication No. 60-35016, since the water storage tank cannot be easily detached from the ice making machine body, the cleaning work has been inconveniently troublesome and the cleaning work of the circulating pump has been undesirably difficult.

SUMMARY OF THE INVENTION

Accordingly, it is an object of the present invention to provide a water trickle type ice making machine in which a water storage tank and parts attached thereto can be cleaned with ease.

In order to achieve the above object, according to the present invention, there is provided a water trickle type ice making machine having an ice making chamber and a machine chamber.

A water storage tank is provided so as to pass through a partition wall part portion by which the ice making chamber is separated from the machine chamber, while extending over the ice making chamber and the machine chamber.

Also, the water storage tank is arranged so that it can be pulled out with respect to the ice making chamber and the machine chamber.

Further, preferably, a cube guide is integrally attached to an upper part of the water storage tank on the side of the ice making chamber and a pump motor is integrally attached to the upper part of the water storage tank on the side of the machine chamber. One of the cube guide and the water storage tank can be provided with ribs and the other of them can be provided with cut-out parts fitted to the ribs. The inner side surfaces of the partition wall part and the side wall part of the ice making chamber facing to the partition wall part may be provided with a pair of protruding parts protruding toward the center of the ice making chamber with their upper surfaces inclined downwardly toward the center of the ice making chamber and the pair of protruding parts abut against the upper part of the cube guide. Recessed parts are preferably formed respectively in the inner parts of the ice making chamber in the partition wall part and the side wall part of the ice making chamber and an evaporator assembly having an evaporator and an ice making plate is preferably mounted on the lower ends of the recessed parts. A collar shaped part may be formed in the end part of a drain pipe for draining ice making water which exceeds an upper limit water level in the water storage tank and the collar shaped part may be mounted on the upper surface of the bottom wall part of the ice making chamber upon assembly of the drain pipe.

DETAILED DESCRIPTION OF THE INVENTION

Now, embodiments of a water trickle type ice making machine according to the present invention will be described by referring to accompanying drawings. Here, rightward and leftward directions in the description designate the right and left directions on a sheet surface of FIG. 1. Further, as for forward and backward directions in the description, the front side of the sheet surface of FIG. 1 designates the forward direction and the back side of the sheet surface designates the backward direction.

Figure 1:
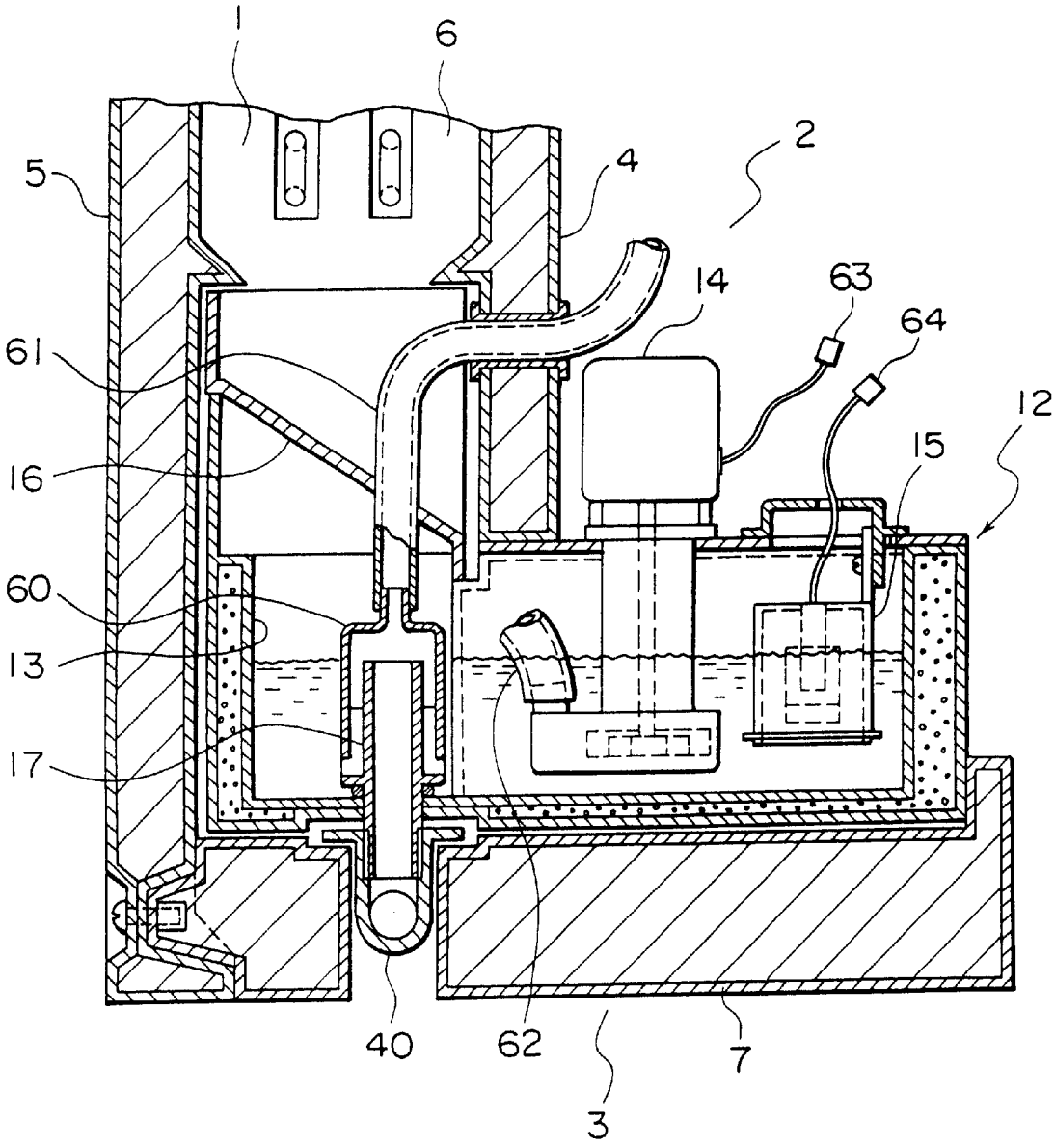
FIG. 1 is a sectional view of an ice making chamber and a machine chamber of a water trickle type ice making machine according to an embodiment of the present invention.
Figure 2:
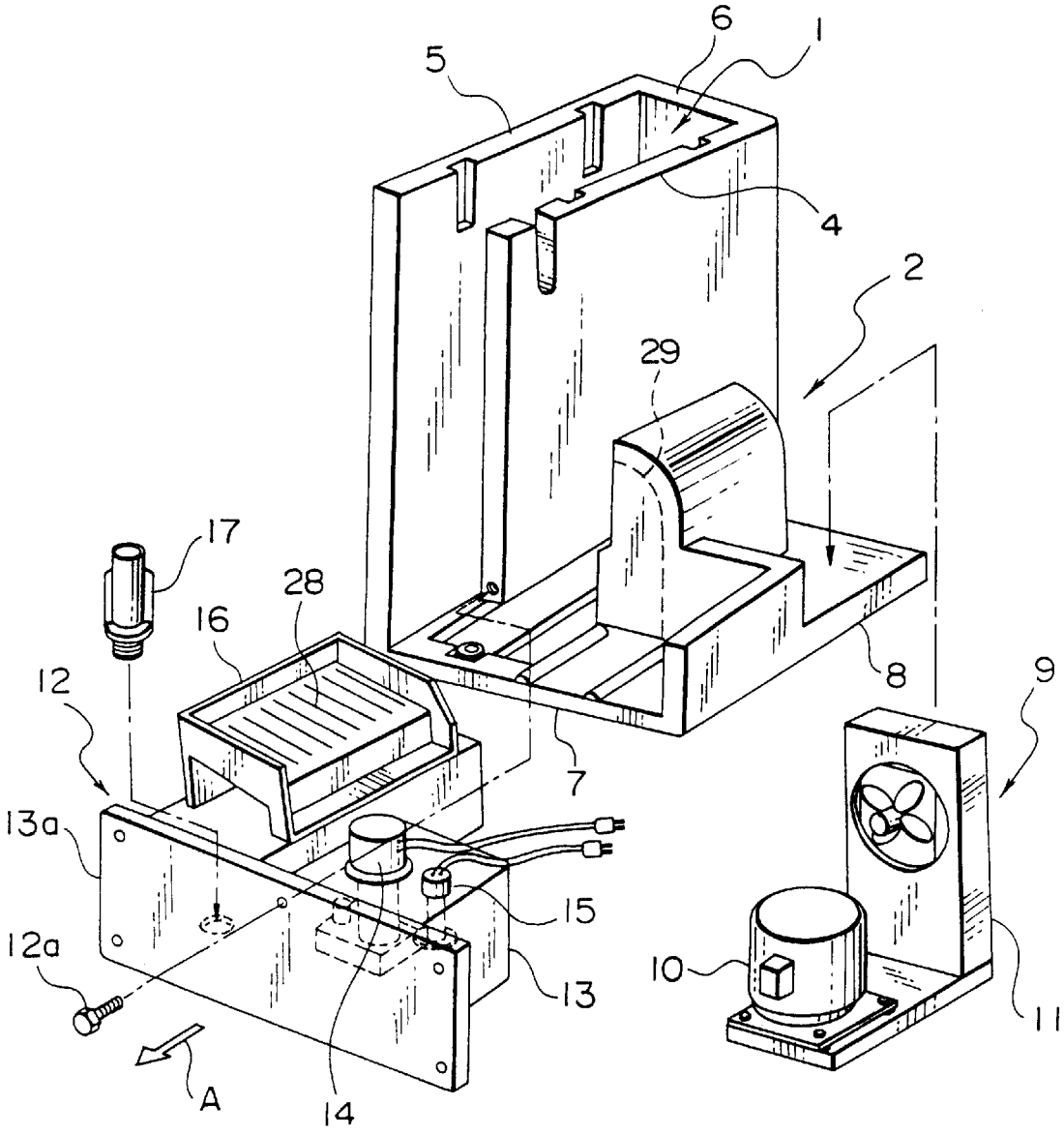
FIG. 2 is an exploded perspective view of the ice making chamber and the machine chamber of the water trickle type ice making machine according to the embodiment of the present invention shown in FIG. 1.

As shown in FIGS. 1 and 2, in an ice making machine body, an ice making chamber 1 and a machine chamber 2 adjacent to each other and an ice storage chamber 3 located below the ice making chamber 1 and the machine chamber 2 are formed. The ice making chamber 1 is defined by a partition wall part 4 by which the ice making chamber 1 is separated from the machine chamber 2, a first side wall part 5 located so as to face to the partition wall part 4, a second side wall part 6 connected to the partition wall part 4 and the first side wall part 5 and a bottom wall part 7 connected to the lower end of the partition wall part 4 and the lower ends of the first side wall part 5 and the second side wall part 6. The partition wall part 4, the first side wall part 5, the second side wall part 6 and the bottom wall part 7 are formed by dividing into two bodies in accordance with, for instance, a structure forging method so as to have hollow inner parts. Then, the hollow parts are filed with a foamed thermal insulation material. The partition wall part 4, the first side wall part 5, the second side wall part 6 and the bottom wall part 7 may be integrally formed by a rotational molding method. Further, when the partition wall part, the side wall parts and the bottom wall part need to be divided into three bodies or four bodies, they may be formed by a blow molding method.

The bottom wall part 7 is partly extended to the machine chamber 2. In a part 8 of the bottom wall part 7 extended to the machine chamber 2, a refrigerating circuit assembly 9 having a condenser 11 or a compressor 10 is arranged. On the upper surface of the bottom wall part 7, a water storage tank assembly 12 is arranged so as to extend over the ice making chamber 1 and the machine chamber 2, that is to say, so as to pass through the lower part of the partition wall part 4. The water storage tank assembly 12 is pulled out forward as shown by an arrow mark A, so that it can be easily taken out from the ice making chamber 1 and the machine chamber 2. Further, the water storage tank assembly 12 is pushed in a direction opposite to the arrow mark A so that the water storage tank assembly 12 can be accommodated in the ice making chamber 1 and the machine chamber 2.

The water storage tank assembly 12 mainly comprises a water storage tank 13, a pump motor 14, a float switch 15, a cube guide 16 and an overflow pipe 17. The water storage tank 13 is formed in an L-shape in plan view. The pump motor 14 for circulating ice making water and the float switch 15 for detecting the lower limit water level of the ice making water are attached to the upper surface of the water storage tank 13 on the side of the machine chamber 2. On the other hand, the upper part of the water storage tank 13 on the side of the ice making chamber 1 is open. The cube guide 16 is located above the opening. The overflow pipe 17 for regulating the upper limit water level of the ice making water is attached to the bottom part of the water storage tank 13 on the side of the ice making chamber 1. Further, the water storage assembly 12 is fixed to the lower part of the partition wall part 4 through machine screws 12*a* passing through a side wall part 13*a* in the front part of the water storage tank 13 upon assembly.

Figure 3:
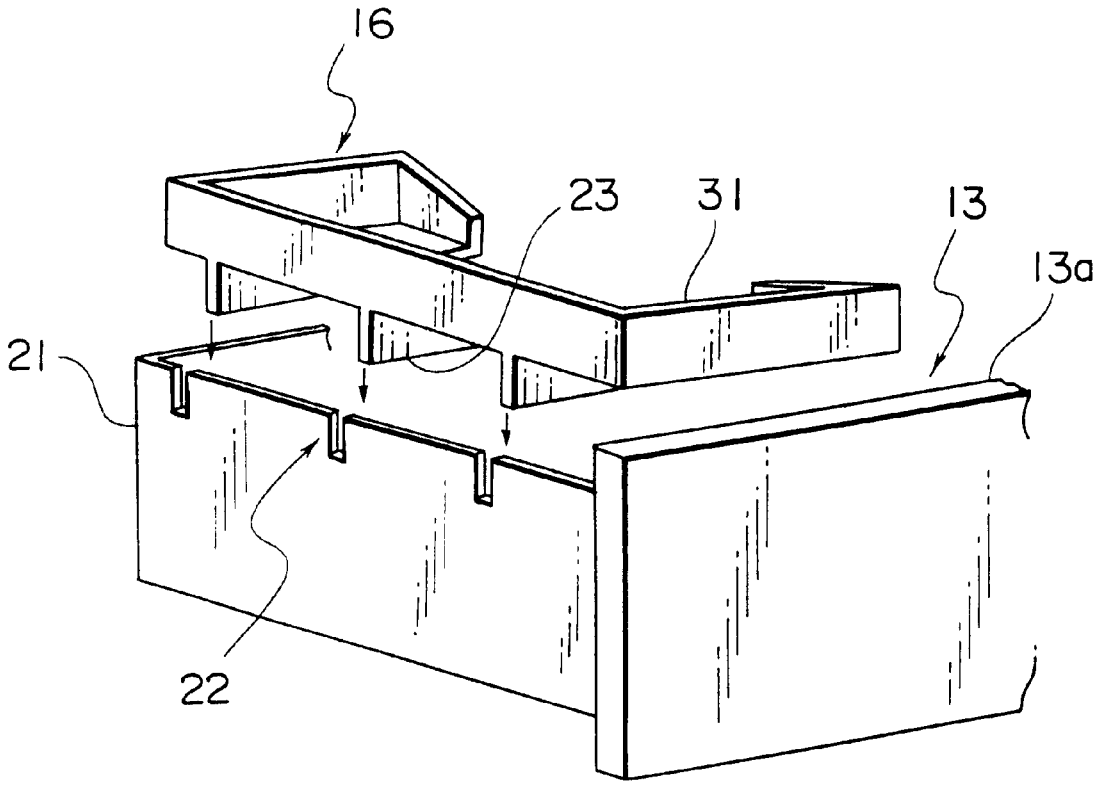
FIG. 3 is an exploded perspective view showing a manner of assembling a water storage tank and a cube guide.
Figure 4:
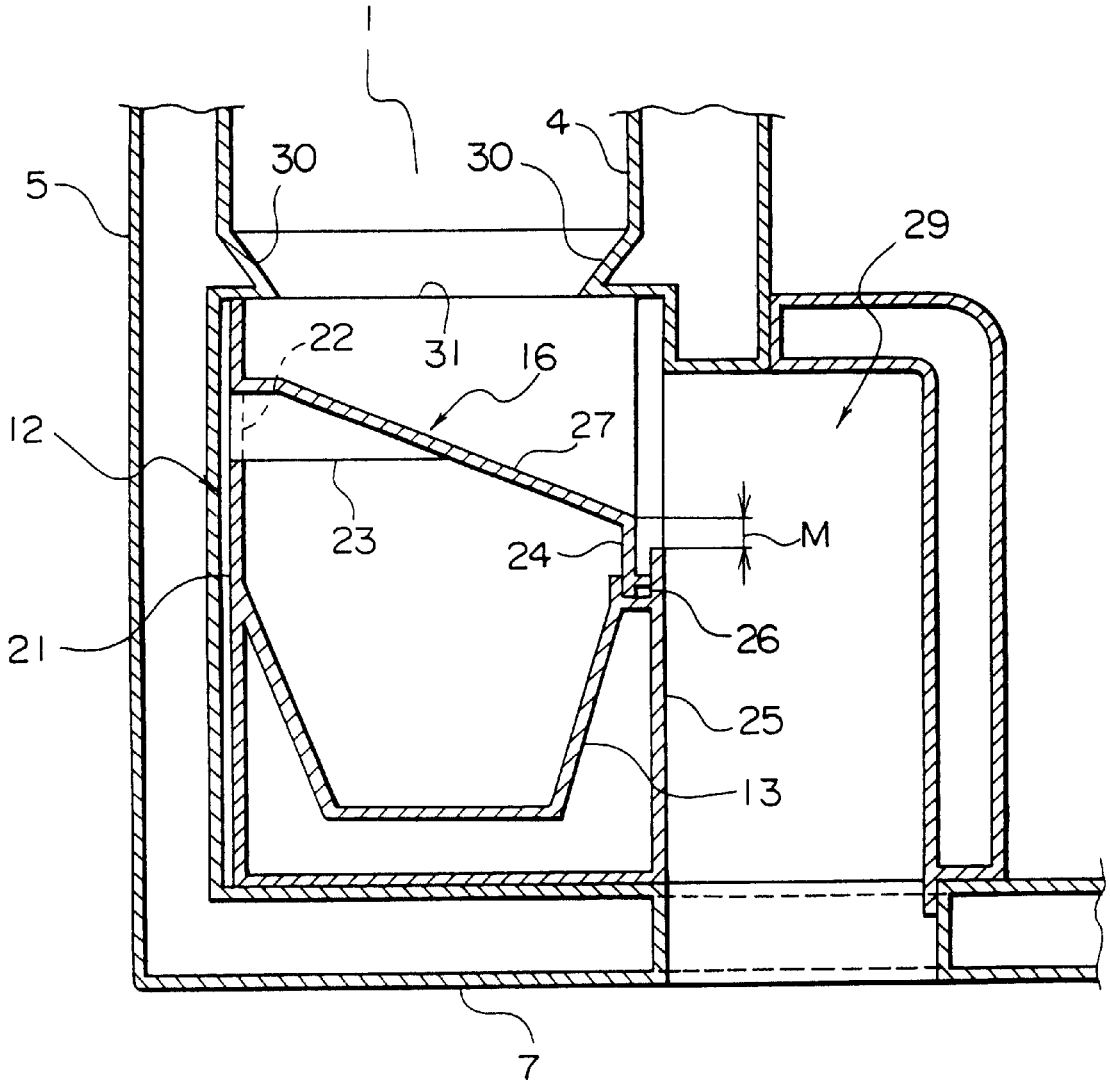
FIG. 4 is a sectional view of the peripheral part of the water storage tank on the side of the ice making chamber.

As shown in FIGS. 3 and 4, a plurality of cut-out parts 22 are formed in the upper end of the left side wall part 21 of the water storage tank 13. On the other hand, ribs 23 are formed on the part of the cube guide 16 facing the respective cut-out parts 22, and, upon assembly, the ribs 23 are fitted in the cut-out parts 22. The plurality of ribs 23 are mutually separated at regular intervals and extend rightward and leftward. The ribs 23 extending rightward and leftward are fitted to the cut-out parts 22 corresponding thereto, so that the forward and backward movement of the cube guide 16 is regulated. Further, the lower end part 24 in the right side of the cube guide 16 is engaged with a groove 26 formed in the upper part of a side wall part 25 in the right side of the water storage tank 13. The cube guide 16 has an inclined guide surface 27 for guiding ice. A distance between the lower end part of the guide surface 27 and the upper end part of the side wall part 25 of the water storage tank 13 is set to a prescribed value M so that the ice can be desirably dropped without stopping the ice on the way. A plurality of slits (shown by reference numerals 28 in FIG. 2), extending in the direction of inclination, are formed on the guide surface 27. Thus, the remaining water of the ice making water passes through these slits to fall to the water storage tank 13 below the guide surface 27 and ice is guided to the water storage chamber 3 by the guide surface 27. On the lower side of the inclination of the guide surface 27, an ice drop passage 29 communicating with the ice storage chamber 3 is formed.

As illustrated in FIG. 4, when the water storage assembly 12 is attached to the ice making chamber 1 and the machine chamber 2, a pair of protruding parts 30 protruding toward the center of the ice making chamber 1 are formed in the inner side surfaces of the partition wall part 4 and the first side wall part 5. Each of the protruding parts 30 is formed in a triangular shape in longitudinal section in its rightward and leftward direction. The upper surface of each protruding part 30 is inclined downward toward the center of the ice making chamber 1 and the lower surface thereof is substantially horizontally extended. The lower surface of each protruding part 30 presses the upper end 31 of the cube guide 16 from above. Thus, each protruding part 30 serves to drop the ice on its upper surface to the center of the cube guide 16 and to regulate the vertical movement of the water storage tank assembly 12 on its lower surface when the water storage tank assembly 12 is attached to the ice making chamber 1 and the machine chamber 2. Further, each protruding part 30 also serves as a guide for positioning the upper part of the water storage tank assembly 12 when the water storage tank assembly 12 is attached to the ice making chamber 1 and the machine chamber 2.

Figure 5:
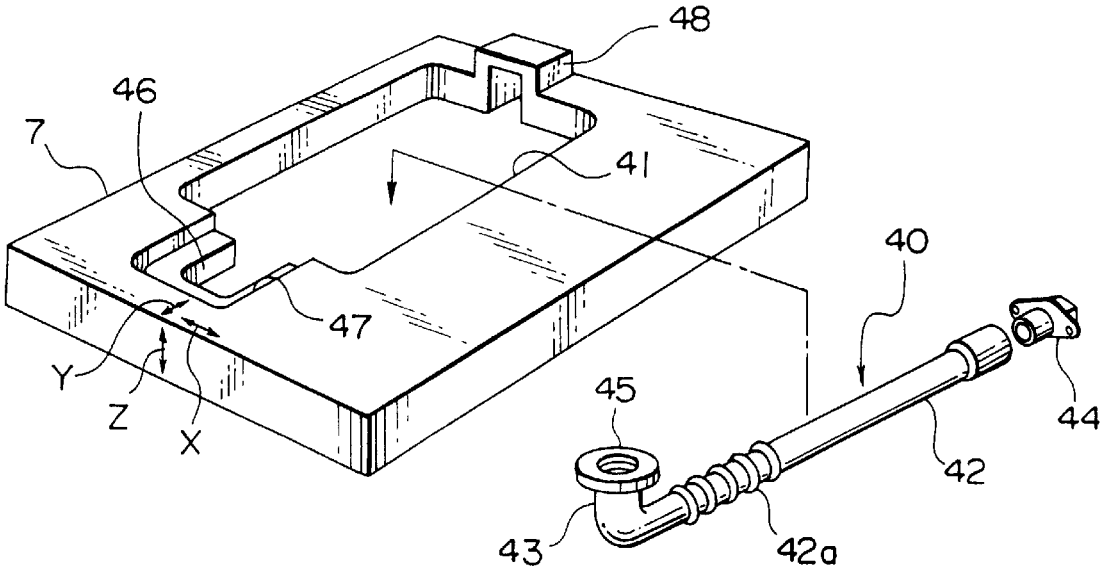
FIG. 5 is an exploded perspective view of the bottom wall part of the ice making chamber and a drain pipe arranged therein.
Figure 6:
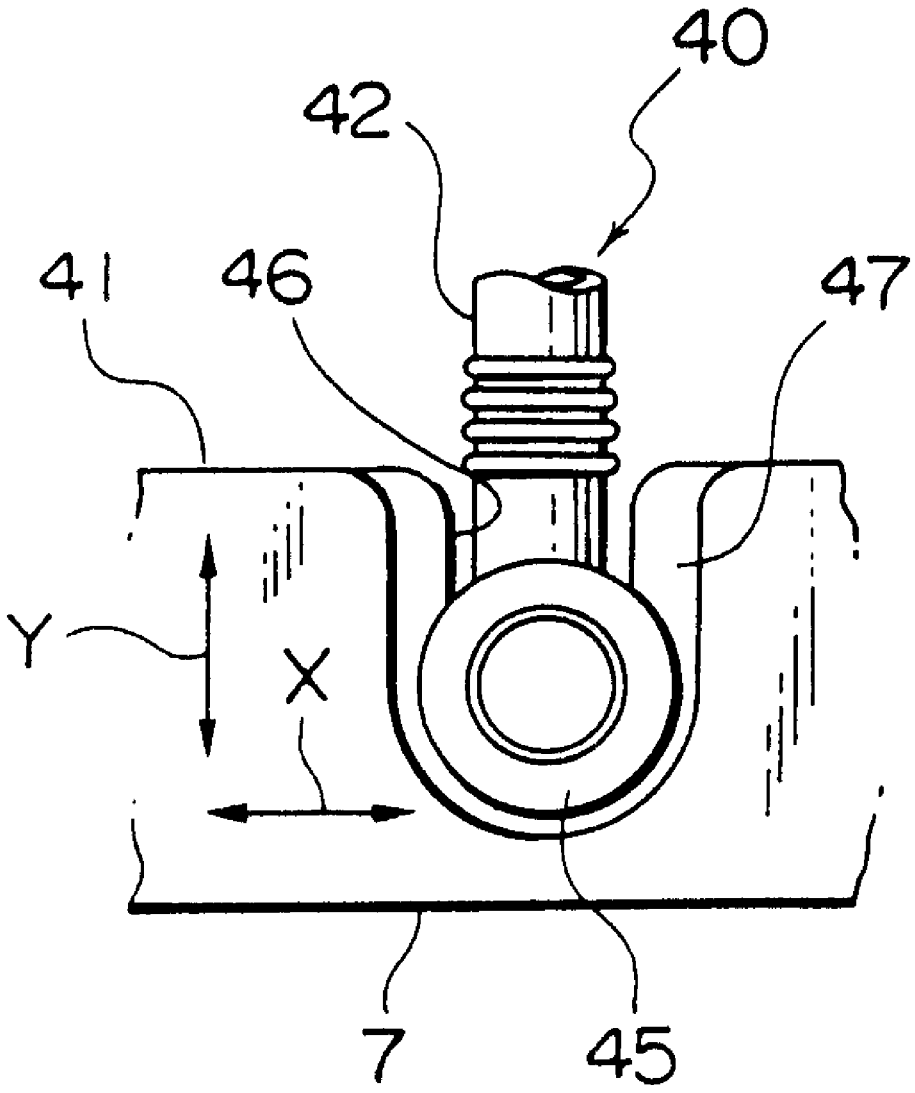
FIG. 6 is a plan view showing a part in the vicinity of the inlet end of the drain pipe attached to the bottom wall part.
Figure 7:
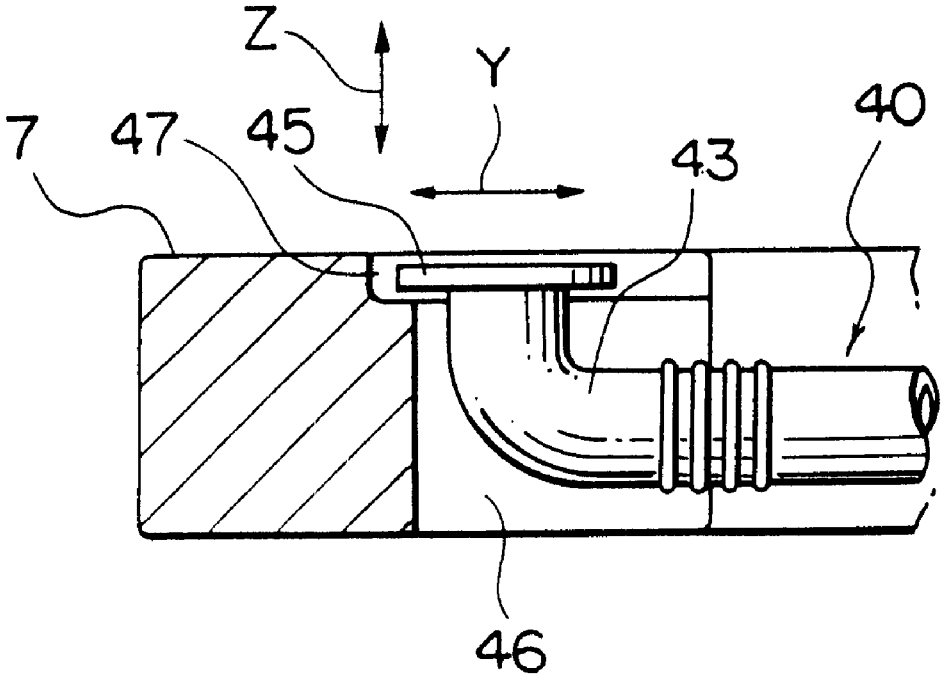
FIG. 7 is a side sectional view showing the part in the vicinity of the inlet end of the drain pipe attached to the bottom wall part.

As shown in FIGS. 5, 6 and 7, in the bottom wall part 7 for defining the ice making chamber 1, an opening part 41 for accommodating a drain pipe 40 is formed. The drain pipe 40 is connected to the overflow pipe 17 provided in the water storage tank 13 so that the ice making water which exceeds an upper limit water level is drained outside by the overflow pipe 17. The drain pipe 40 has a central part 42 made of a soft material (for instance, rubber or a soft PVC). A flexible part 42*a* is provided in the central part 42, and the flexible part 42*a* is expansible in the longitudinal direction of the pipe. On the other hand, the inlet end part 43 and the outlet end part 44 of the drain pipe are respectively made of a hard material. Further, on the end of the inlet end part 43, a collar shaped part 45 whose diameter is larger than those of other parts is formed. An end accommodating part 46 for accommodating the inlet end part 43 of the drain pipe 42 has its width smaller than that of other parts of the opening part 41. The upper surface of the bottom wall part 7 for defining the end accommodating part 46 is provided with a recessed part 47 for accommodating the collar shaped part 45. The rear part of the bottom wall part 7 is provided with an end fixing part 48 for fixing the outlet end part 44.

After the drain pipe 40 is accommodated in the opening part 41, the outlet end part 44 is fixed to the end fixing part 48 and the inlet end part 43 is held on the recessed part 47 through the collar shaped part 45. Under this state, the drain pipe 40 is connected to the overflow pipe 17 of the water storage tank 13. At this time, the inlet end part 43 is only mounted on the bottom wall part 7 so that it can move rightward and leftward X, forward and backward Y and upward and downward Z to some degree. Thus, even when there exists an error in the relative arrangement dimension between the drain pipe 40 and the overflow pipe 17, the position of the inlet end part 43 can be corrected to a proper position as the drain pipe 40 is screwed to the overflow pipe 17.

Figure 8:
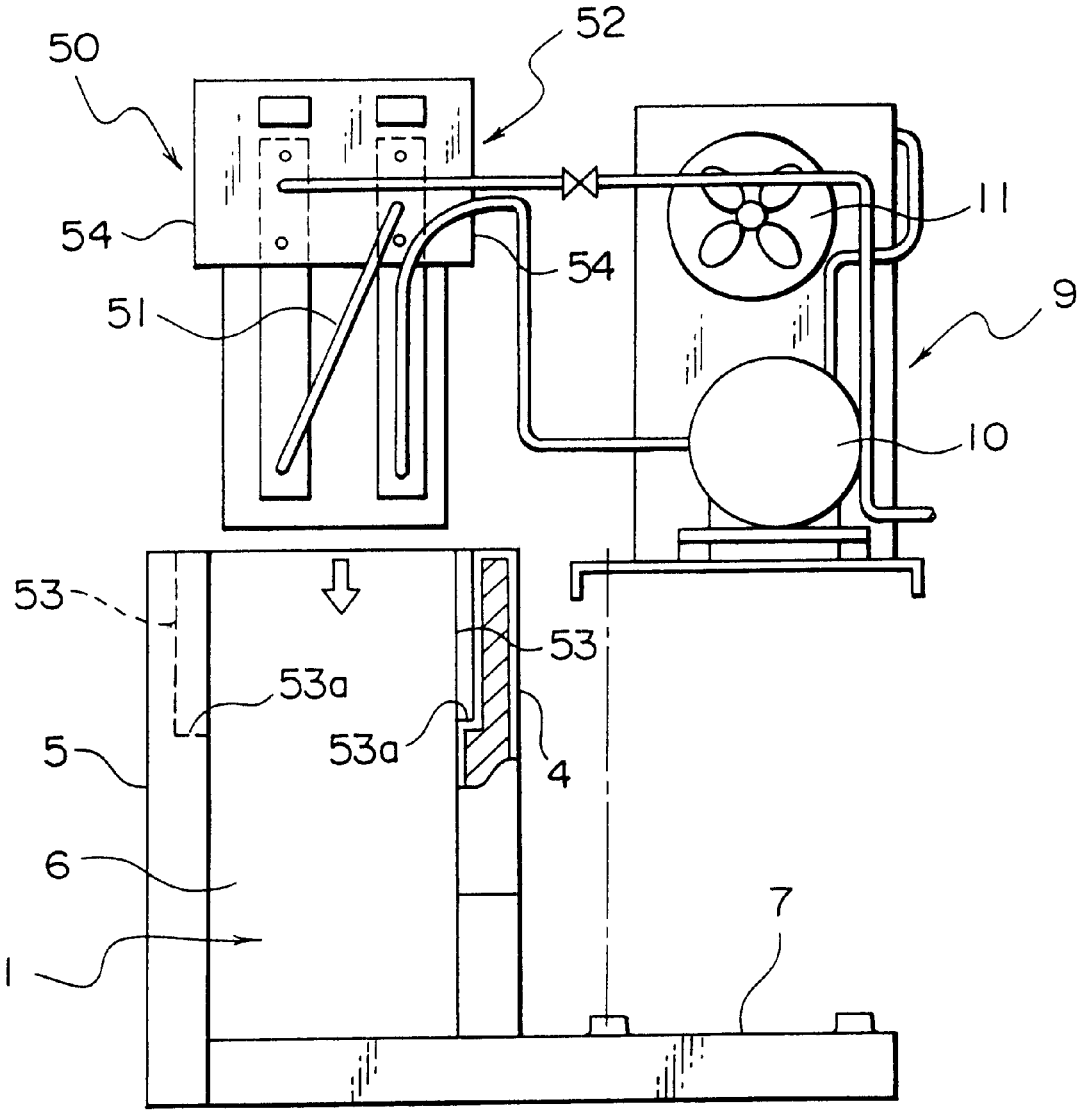
FIG. 8 is a view showing the arrangement manner of an evaporator assembly in the ice making chamber.

As shown in FIG. 8, an evaporator 51 provided in an evaporator assembly 50 is connected to the compressor 10 and the condenser 11 of the refrigerating circuit assembly 9. The evaporator 51 is supported by evaporator brackets 52 as pairs of side end plates provided in both the front and back ends of the evaporator assembly 50. On the other hand, in the respective inner sides of the partition wall part 4 and the first side wall part 5, recessed parts 53 extend vertically and are formed so as to be separated from each other in forward and backward directions. The edges 54 of the evaporator brackets 52 of the evaporator assembly 50 are accommodated in these four recessed parts 50. In other words, the evaporator assembly 50 is inserted into the ice making chamber 1 from above and the edges 54 of the evaporator brackets 52 are respectively inserted into the corresponding recessed parts 53 at that time. Therefore, attaching screws are not required and an assembly property is improved. Further, since the evaporator assembly 50 is supported by the lower end parts 53a of the recessed parts 53 in the lower ends of the evaporator brackets 52, the evaporator brackets 52 are broken more rarely than an attaching method using screws or the like to which load is locally applied.

In the water trickle type ice making machine configured as mentioned above, the water storage tank assembly 12 is assembled in a sub-line, then, inserted into the ice making chamber 1 and the machine chamber 2 in the manner of a drawer and the overflow pipe 17 is connected to the drain pipe 40 through an O ring which is not shown. Then, as shown in FIG. 1, the overflow pipe 17 is covered with a drain connecting cap 60 and connected to a drain hose 61. Further, one end of a circulating pipe 62 is connected to the discharge port of the pump motor 14 and the other end of the circulating pipe 62 is connected to a sprinkler, which is not shown, constituting the evaporator assembly 50. Further, the connectors 63 and 64 of the pump motor 14 and the float switch 15 are connected to a controller not shown of the machine chamber 2. In other words, since the pump motor 14, the float switch 15 and the like are assembled in the sub-line, an assembly property is good and serviceability is excellent. Still further, since the pump motor 14 and the float switch 15 are located in the machine chamber 2 with less moisture, they are excellent in their durability.

When it is desired to clean the pump motor 14 and the float switch 15, the water storage tank assembly 12 can be detached from the ice making chamber and the machine chamber 2 in accordance with a procedure that is reverse to the above described assembly procedure. Therefore, the water storage tank 13 can be entirely detached from the ice making chamber and the machine chamber, and thus, it can be completely cleaned in all corners. Further, the inner parts of the pump motor 14 and the float switch 15 can be detached therefrom and cleaned.

Figure 9:
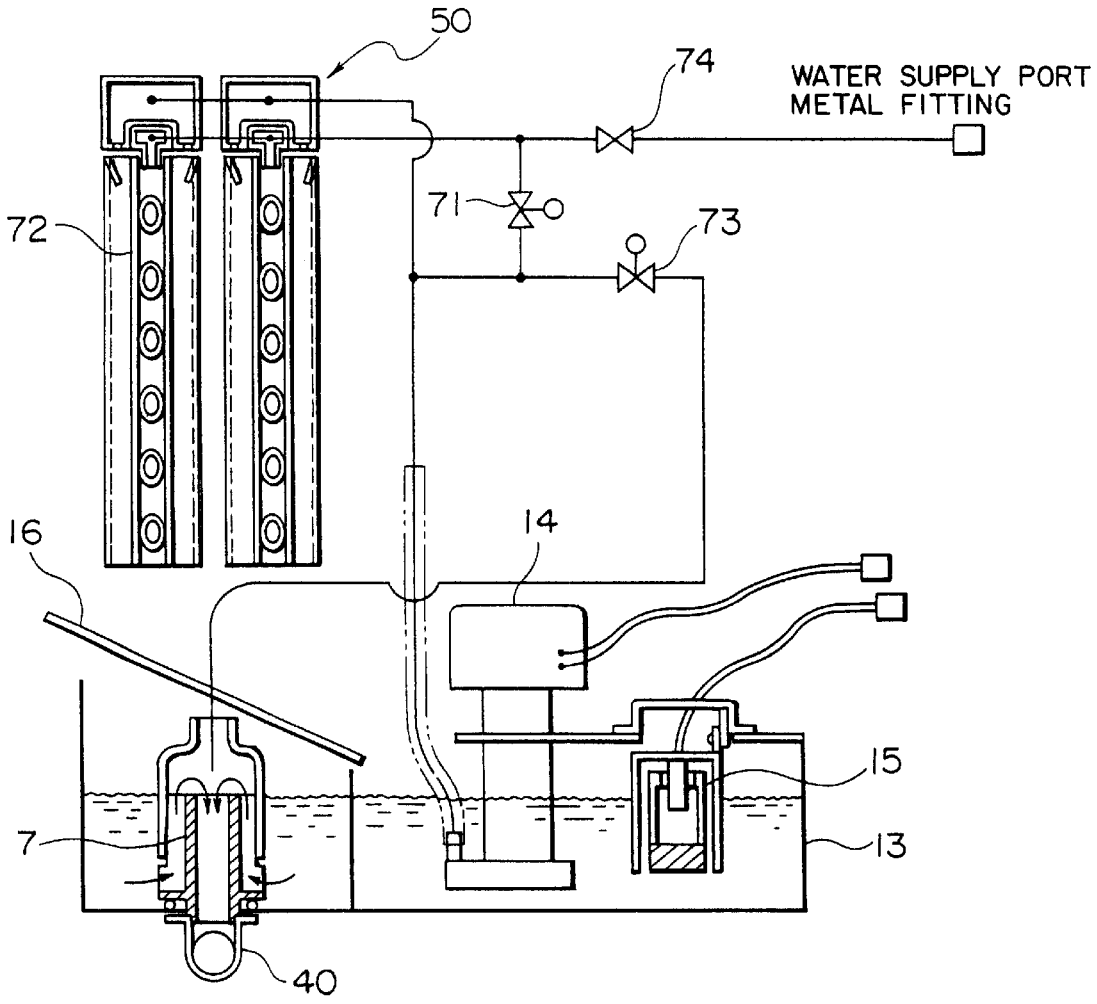
FIG. 9 is a view showing a water circulating system in the water trickle type ice making machine according to the embodiment of the present invention.

Furthermore, a user can perform a cleaning operation in such a manner as described below. Initially, after the ice making machine is stopped, a detergent is put in the water storage tank 13. As shown in FIG. 9, a flush valve (solenoid valve for water) 71 is opened and the pump motor 14 is driven to allow the detergent to flow to an ice making plate 72. When a cleaning operation is sufficiently carried out, the flush valve 71 is closed and a drain valve 73 is opened to discharge the detergent. Then, water is supplied to the water storage tank 13 to carry out the same operations as described above and completely wash away the detergent.

Figure 10:
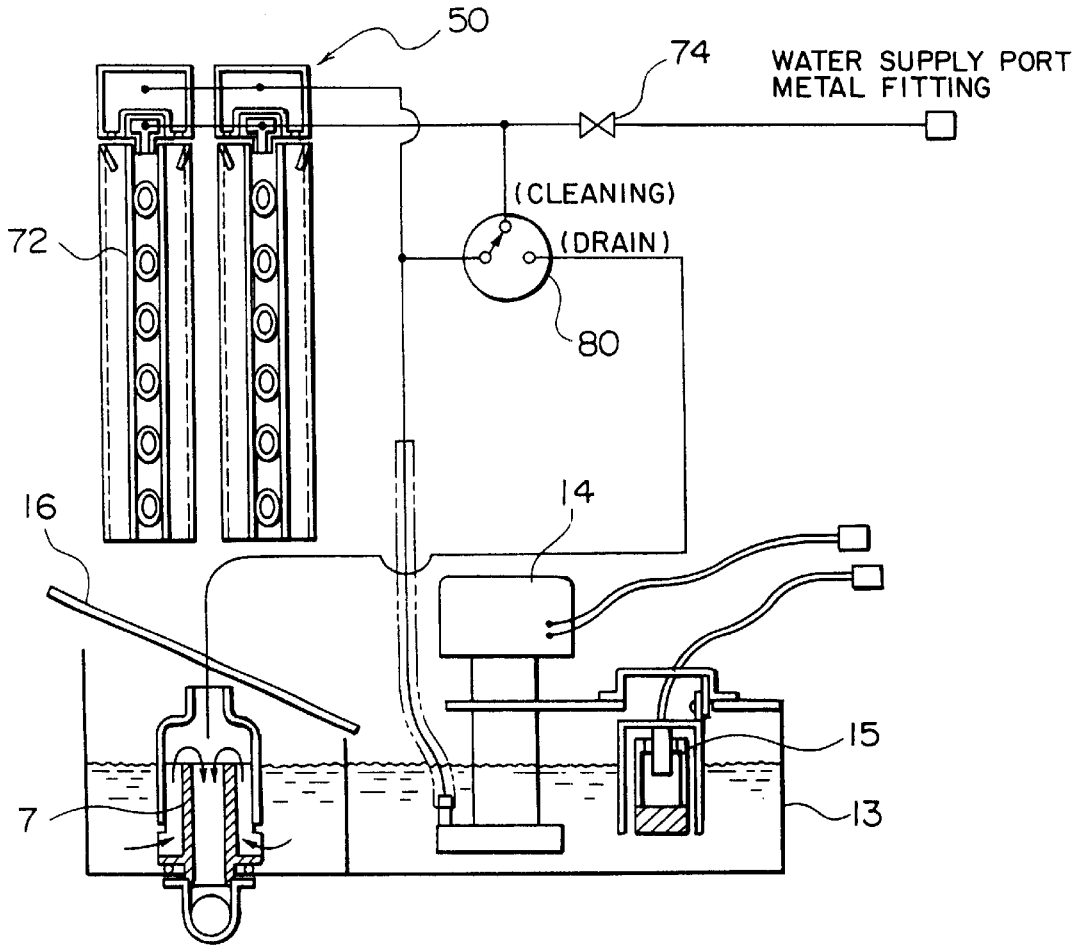
FIG. 10 is a view showing a modified water circulating system in the water trickle type ice making machine according to the embodiment of the present invention.
Figure 11:
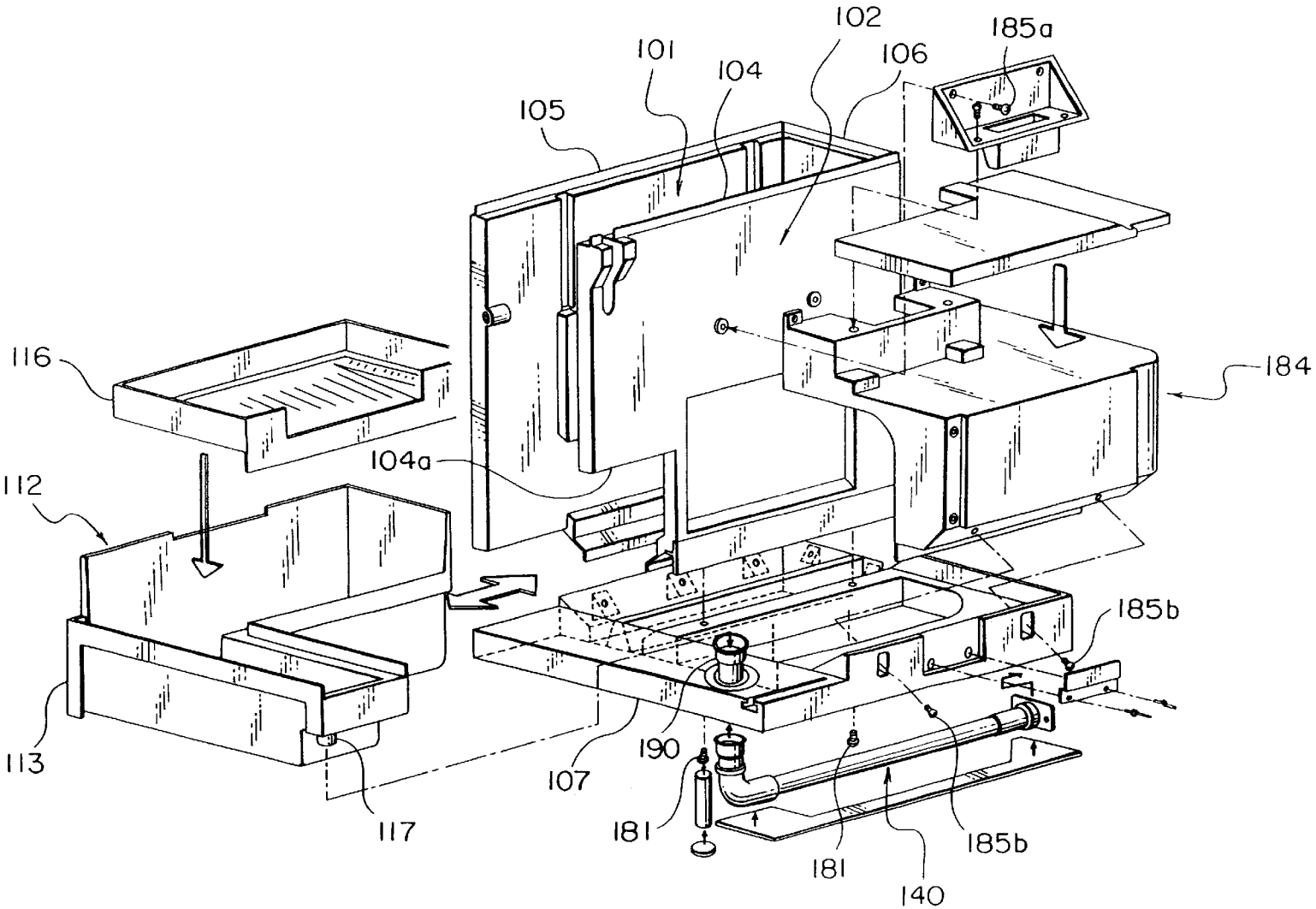
FIG. 11 is an exploded perspective view of components in the vicinity of an ice making chamber and a machine chamber of a water trickle type ice making machine of another embodiment of the present invention.

Further, when an ice making operation is continued under a simple overflow, the concentration of impurities in the water storage tank 13 gradually becomes high and scale or a stain is likely to adhere to the water storage tank 13, so that an automatic draining work is carried out as described below after the ice making operations are repeated for several cycles. In a controller not shown, the number of times of ice making operations is counted. At the time of a next ice removal after the prescribed number of counts, before ice making water is supplied, the drain valve 73 is opened and the pump motor 14 is driven for the prescribed time (time for the water storage tank to be empty). Thus, the remaining ice making water is drained through the overflow pipe 17 and the drain pipe 40. With the lapse of prescribed time, a water supply valve 74 is opened to start the ice making operation as usual. Note that, as mentioned above, when the water storage tank is cleaned by the user or automatically cleaned, a three-way valve (solenoid selector valve) 80 may be used as shown in FIG. 10, in place of the flush valve 71 and the drain valve 73 shown in FIG. 9.

It is understood that the present invention is not limited to the above-described embodiment and, for instance, the invention may be modified as described below. An ice making chamber 101 is defined by a partition wall part 104 by which the ice making chamber 101 is separated from a machine chamber 102, a first side wall part 105 located so as to face to the partition wall part 104, a second side wall part 106 connected to the partition wall part 104 and the first side wall part 105 and a bottom wall part 107 connected to the lower end of the partition wall part 104 and the lower ends of the first side wall part 105 and the second side wall part 106. The partition wall part 104, the first side wall part 105 and the second side wall part 106 are integrally connected together and they are connected to the bottom wall part 107 by a plurality of machine screws 181. Further, in the machine chamber 102, a base case assembly 184 is connected to a part of the partition wall part 104 on the side of the machine chamber 102 and a part of the bottom wall part 107 on the side of the machine chamber 102 through a plurality of machine screws 185*a* and 185*b*.

A water storage tank assembly 112 mainly comprises a water storage tank 113, a cube guide 116 arranged in the upper part thereof, an overflow pipe 117 and a pump motor and a float switch which are not shown. The water storage tank 113 is formed in an L-shape in plan view. The water storage tank assembly 112 can be detachably attached to an assembly having the partition wall part 104, the first side wall part 105, the second side wall part 106 and the bottom wall part 107 so that it can be pulled out with respect to the assembly. In other words, under a state in which the water storage tank assembly is attached to the assembly, the water storage tank 113 is arranged so as to pass through the lower cut-out part 104*a* of the partition wall part 104 and extend over the ice making chamber 101 and the machine chamber 102. The overflow pipe 117 is attached to the bottom part of the water storage tank 113 on the side of the machine chamber 102.

Further, a drain pipe assembly 140 is attached to a part of the bottom wall part 107 on the side of the machine chamber 102. That is to say, on the bottom wall part 107, a connecting pipe part 190 is provided and the inlet side of the drain pipe assembly 140 is connected to the lower end of the pipe part 190. The overflow pipe 117 of the water storage tank assembly 112 is fitted to the upper end of the connecting pipe part 190. When the water storage tank assembly 112 is pulled out or attached to the assembly having the partition wall part 104, the first side wall part 105, the second side wall part 106 and the bottom wall part 107, it can be easily separated from and connected to the assembly.

Even in the above described configuration, the water storage tank assembly 112 can be readily inserted into and pulled out from the ice making chamber 101 and the machine chamber 102 so that the water storage tank can be cleaned with ease. When it is desired to clean the pump motor and the float switch or the like, since the water storage tank assembly 112 can be detached from the ice making chamber 101 and the machine chamber 102, they can be completely washed out to all corners.

As described above, in the trickle type ice making machine according to the present invention, since the water storage tank can be simply detached from the ice making chamber and the machine chamber, the water storage tank can be easily cleaned.

Further, according to the invention, since the pump motor is provided in the upper part of the water storage tank on the side of the machine chamber, the life of the pump motor as a product can be prevented from being lowered due to moisture and the assembly property can be improved due to the assembly of the pump motor in the sub-line.

Further, according to the invention, the cube guide and the water storage tank can be easily assembled and disassembled.

Further, according to the invention, the ice is collected at the center of the cube guide and the cube guide and the water storage tank can be easily positioned when the cube guide and the water storage tank are inserted into the ice making chamber and the machine chamber by a pair of protruding parts formed in the inner side surfaces of the partition wall part and the side wall part of the ice making chamber facing the partition wall part.

Further, according to the invention, the screws for attaching the evaporator assembly are not required and the assembly characteristic of the evaporator assembly is improved. Further, since the evaporator assembly is supported by the lower ends of the recessed parts, the evaporator assembly is broken more rarely than the attaching method using the screws to which the load is locally applied.

Further, according to the invention, even when there is an error in the dimensional arrangement between the drain pipe and the overflow pipe, which is connected thereto, the drain pipe and the overflow pipe can be connected together with ease.

What is claimed is:

1. A water trickle type ice making machine comprising:

an ice making chamber;

a machine chamber separated from the ice making chamber by a partition wall; and a water storage tank extending over the ice making chamber and the machine chamber while passing through a portion of the partition wall, wherein a portion of the partition wall is spaced from a bottom wall part, which defines part of the ice making chamber, so as to define an open portion for receiving the water storage tank, wherein the water storage tank is arranged so as to be capable of being pulled out with respect to the ice making chamber and the machine chamber through the open portion.

2. A water trickle type ice making machine according to claim 1, further comprising:

a cube guide integrally attached to an upper portion of the water storage tank on the side of the ice making chamber; and a pump motor integrally attached to the upper portion of the water storage tank on the side of the machine chamber.

3. A water trickle type ice making machine according to claim 2, wherein one of the cube guide and the water storage tank is provided with ribs and the other of the cube guide and the water storage tank is provided with cut-out portions to be fitted to the ribs.

4. A water trickle type ice making machine according to claim 3, wherein inner side surfaces of the partition wall part and the side wall part portion of the ice making chamber facing the partition wall part are provided with a pair of protruding portions, which protrude toward a center of the ice making chamber with their upper surfaces inclined downwardly toward the center of the ice making chamber, and the pair of protruding portions abut against an upper portion of the cube guide.

5. A water trickle type ice making machine according to claim 1, wherein recessed portions are formed in respective inner portions of the ice making chamber in the partition wall part and the side wall part portion of the ice making chamber, and an evaporator assembly having an evaporator and an ice making plate is mounted on lower ends of the recessed portions.

6. A water trickle type ice making chamber according to claim 1, further comprising a drain pipe for draining ice making water which exceeds an upper limit water level in the water storage tank, wherein a collar shaped portion is formed in an end portion of the drain pipe, and the collar shaped portion is mounted on an upper surface of a bottom wall part portion of the ice making chamber upon assembly of the drain pipe.

7. A water trickle type ice making machine according to claim 2, wherein recessed portions are formed in respective inner portions of the ice making chamber in the partition wall part and the side wall part portion of the ice making chamber, and an evaporator assembly having an evaporator and an ice making plate is mounted on lower ends of the recessed portions.

8. A water trickle type ice making machine according to claim 3, wherein recessed portions are formed in respective inner portions of the ice making chamber in the partition wall part and the side wall part portion of the ice making chamber, and an evaporator assembly having an evaporator and an ice making plate is mounted on lower ends of the recessed portions.

9. A water trickle type ice making machine according to claim 4, wherein recessed portions are formed in respective inner portions of the ice making chamber in the partition wall part and the side wall part portion of the ice making chamber, and an evaporator assembly having an evaporator and an ice making plate is mounted on lower ends of the recessed portions.

10. A water trickle type ice making chamber according to claim 2, further comprising a drain pipe for draining ice making water which exceeds an upper limit water level in the water storage tank, wherein a collar shaped portion is formed in an end portion of the drain pipe, and the collar shaped portion is mounted on an upper surface of a bottom wall part portion of the ice making chamber upon assembly of the drain pipe.

11. A water trickle type ice making chamber according to claim 3, further comprising a drain pipe for draining ice making water which exceeds an upper limit water level in the water storage tank, wherein a collar shaped portion is formed in an end portion of the drain pipe, and the collar shaped portion is mounted on an upper surface of a bottom wall part portion of the ice making chamber upon assembly of the drain pipe.

12. A water trickle type ice making chamber according to claim 4, further comprising a drain pipe for draining ice making water which exceeds an upper limit water level in the water storage tank, wherein a collar shaped portion is formed in an end portion of the drain pipe, and the collar shaped portion is mounted on an upper surface of a bottom wall part portion of the ice making chamber upon assembly of the drain pipe.

13. A water trickle type ice making chamber according to claim 5, further comprising a drain pipe for draining ice making water which exceeds an upper limit water level in the water storage tank, wherein a collar shaped portion is formed in an end portion of the drain pipe, and the collar shaped portion is mounted on an upper surface of a bottom wall part portion of the ice making chamber upon assembly of the drain pipe.

14. A water trickle type ice making chamber according to claim 1, wherein the water storage tank is detachably secured to the partition wall.

15. A water trickle type ice making chamber according to claim 1, wherein the water storage tank is detachably secured to the partition wall by at least one screw.

* * * * *